US009789490B2

(12) United States Patent
Galvin

(10) Patent No.: US 9,789,490 B2
(45) Date of Patent: Oct. 17, 2017

(54) ENHANCED GRAVITY SEPARATION DEVICE USING CLOSELY SPACED CHANNELS

(75) Inventor: Kevin Patrick Galvin, Callaghan (AU)

(73) Assignee: NEWCASTLE INNOVATION LIMITED, New South Wales (AU)

( * ) Notice: Subject to any disclaimer, the term of this patent is extended or adjusted under 35 U.S.C. 154(b) by 817 days.

(21) Appl. No.: 13/638,379

(22) PCT Filed: Mar. 29, 2011

(86) PCT No.: PCT/AU2011/000350

§ 371 (c)(1),
(2), (4) Date: Sep. 28, 2012

(87) PCT Pub. No.: WO2011/120078

PCT Pub. Date: Oct. 6, 2011

(65) Prior Publication Data

US 2013/0023397 A1 Jan. 24, 2013

(30) Foreign Application Priority Data

Mar. 29, 2010 (AU) ..... 2010901303

(51) Int. Cl.
*B03B 5/32* (2006.01)
*B04B 1/00* (2006.01)
(Continued)

(52) U.S. Cl.
CPC ..... *B03B 5/32* (2013.01); *B04B 1/00* (2013.01); *B04B 1/04* (2013.01); *B04B 11/02* (2013.01); *B04B 11/06* (2013.01)

(58) Field of Classification Search
CPC .... B03B 5/32; B04B 1/04; B04B 1/00; B04B 5/04; B04B 5/0407; B04B 5/0442; B04B 11/06
(Continued)

(56) References Cited

U.S. PATENT DOCUMENTS 2,502,704 A 4/1950 Chisholm
2,557,629 A * 6/1951 Boivinet ..... B04B 1/00 422/270
(Continued)

FOREIGN PATENT DOCUMENTS

CN 2656015 11/2004
CN 2829892 10/2006
(Continued)

OTHER PUBLICATIONS

International Search Report for PCT/AU2011/000350, Completed by the Australian Patent Office on May 12, 2011, 3 Pages.
(Continued)

*Primary Examiner* — Charles Cooley
*Assistant Examiner* — Shirley S Liu
(74) *Attorney, Agent, or Firm* — Brook Kushman P.C.

(57) ABSTRACT

An enhanced gravity separation device rotates a plurality of rectangular section vessels about a central drive shaft. Each vessel has an array of closely spaced plates positioned with the vessel between outer regions and inner regions. A feed of mixed dense and less dense fluid matter is fed to the outer regions via a pipe and conduits, through the plate arrays and into the inner regions. Overflow of less dense matter reports to the inner regions and underflow of denser matter reports to the outer region. The vessels may be fluidized by liquid supplied into the outer regions via annulus and conduits.

16 Claims, 2 Drawing Sheets

(51) Int. Cl.
*B04B 1/04* (2006.01)
*B04B 11/02* (2006.01)
*B04B 11/06* (2006.01)

(58) Field of Classification Search
USPC ..... 494/16, 79
See application file for complete search history.

(56) References Cited

U.S. PATENT DOCUMENTS 2,788,937 A * 4/1957 Weiland ..... B04B 1/08 494/27
3,825,175 A * 7/1974 Sartory ..... B04B 5/0442 494/27
3,927,826 A * 12/1975 Anderson et al. ..... 494/4
4,120,450 A 10/1978 Whitehead
4,885,137 A * 12/1989 Lork ..... B01J 8/226 165/104.16
4,976,678 A * 12/1990 Suginaka ..... B04B 1/12 494/56
2008/0045396 A1* 2/2008 Aagaard et al. ..... 494/50

FOREIGN PATENT DOCUMENTS

EP 0320105 6/1989
EP 0320105 A1 * 6/1989 ..... B04B 1/08
EP 0346056 12/1989
EP 0806985 7/2002
GB 962386 A * 7/1964 ..... B01D 21/0018
WO 8604270 7/1986
WO 0045949 8/2000

OTHER PUBLICATIONS

Extended European Search Report for European Application No. 11761820.7, Completed by the European Patent Office, Dated Jan. 25, 2016, 7 Pages.

* cited by examiner

ENHANCED GRAVITY SEPARATION DEVICE USING CLOSELY SPACED CHANNELS

CROSS-REFERENCE TO RELATED APPLICATION

This application is the U.S. national phase of PCT Appln. No. PCT/AU2011/000350 filed on Mar. 29, 2011, which claims priority to Australian Patent Application No. 2010901303 filed on Mar. 29, 2010, the disclosures of which are incorporated in their entirety by reference herein.

FIELD OF THE INVENTION

This invention relates to enhanced gravity separation using closely spaced channels and has been devised particularly, but not solely, for the separation of mixed denser and less dense particles in a fluid feed.

BACKGROUND OF THE INVENTION

Throughout this specification, and in the claims, the term "particles" is used in a broad sense to refer not only to discrete items of solid matter but also to aggregated items of solid matter, and discrete or aggregated bubbles or drops of liquid material.

Gravity separation is concerned with the separation of particles on the basis of density, often requiring the hydrodynamic suppression of the effects of particle size. Various technologies have been developed to promote gravity separation, but all suffer from the effects of particle size variation within the feed. Ideally, in gravity separation the low density particles report as part of one flow stream, and the higher density particles report as another stream. In practice, however, this ideal result is not achieved. By way of example in a fluidized bed separator the higher density particles generally settle faster, but the very finest of the high density particles settle slowly, and join the lower density stream. Conversely, the very largest of the low density particles settle more rapidly and will appear with the denser particles. In a spirals separator the separation is more complex, however, again the separation only covers a limited size range.

Enhanced gravity separation methods utilize centrifugal forces to promote the separation of ultrafine particles, typically down to 0.010 mm. These devices operate according to the principles of solid-liquid fluidized beds. Through an increase in the so-called "g force" higher settling velocities and hence higher solids rates are achieved. With the higher "g force", the intermediate regime of settling shifts to finer particles, which in turn reduces the dependence of the particle settling velocity on particle size for those finer particles. Hence, the centrifugal force suppresses the effects of particle size, in turn promoting gravity separation below 0.100 mm and often down to 0.01 mm.

The present invention is derived from a new and powerful separation mechanism, using closely spaced inclined channels. With closely spaced inclined channels the flow becomes laminar and the shear rate increases, producing inertial lift. Particles which settle within the intermediate flow regime, with a particle Reynolds number between about 1 and 500, elutriate on the basis of density, with particle size playing almost no role. Particles larger than about 0.100 mm thus separate on the basis of density. For binary systems involving a significant density difference between the particle species, complete separation of particles larger than about 0.040 mm is possible. This mechanism has been used in a Reflux Classifier of the type described in our International Patent Application PCT/AU00/00058 modified with the closely spaced inclined channels separated by, for example, a distance of 1.77 mm. The inclined channels were 1.0 m long.

SUMMARY OF THE INVENTION

The present invention therefore provides an enhanced gravity separation device including one or more vessels having outer and inner regions, rotatable about a central shaft, means for introducing a feed of mixed denser and less dense fluid matter into the vessels and directing the feed to the outer regions, an array of closely spaced inclined plates positioned within the or each vessel between the outer and inner regions such that overflow of less dense matter from the array reports to the inner region, and underflow of denser matter reports to the outer region, and means for moving the underflow and overflow from the device.

Preferably, the closely spaced inclined plates are separated by spacings less than 6 mm.

More preferably, the spacings are less than 2 mm.

Preferably, the fluid matter comprises a mix of denser and less dense particles in a liquid and wherein the less dense particles report to the inner region and the denser particles report to the outer region.

Alternatively, the fluid matter comprises particles in a liquid and wherein a dilute stream of liquid substantially free of particles reports to the inner region, and a concentrated stream containing a high fraction of particles reports to the outer region.

Alternatively again, the fluid matter comprises particles of similar density in a liquid and wherein the liquid and finer particles reports to the inner region, and a concentrated stream containing a high fraction of coarser particles reports to the outer region.

Preferably each array of closely spaced inclined plates is located within a substantially rectangular box having an outer end open to the outer region and an inner end open to the inner region.

Preferably each rectangular box extends in a substantially radial direction from the central shaft like the spokes of a wheel.

Preferably a fluidization fluid is introduced into the periphery of the outer region, causing a fluidized bed to form in this region.

Preferably the underflow is removed by the periodic opening of one or more valves in the outer region.

BRIEF DESCRIPTION OF THE DRAWINGS

Notwithstanding any other forms that may fall within its scope one preferred form of the invention will now be described by way of example only with reference to the accompanying drawings in which.

DETAILED DESCRIPTION OF PREFERRED EMBODIMENTS OF THE INVENTION

Figure 1:
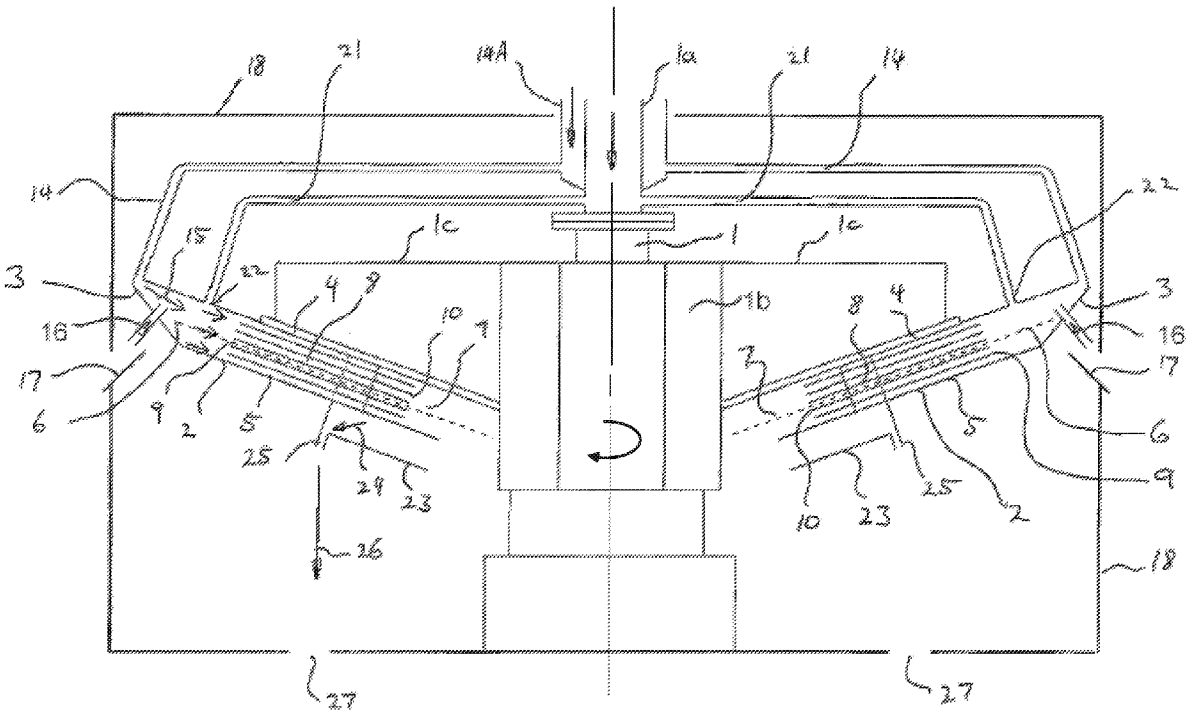
FIG. 1 is a cross-sectional elevation of an enhanced gravity separation device according to the invention.

The enhanced gravity separation device according to the invention comprises a central drive shaft 1 arranged to be driven at an appropriate speed by a drive means, typically including an electric motor (not shown). The central shaft 1 is preferably vertically orientated as shown in FIG. 1 but could be horizontal or inclined in other applications.

Figure 2:
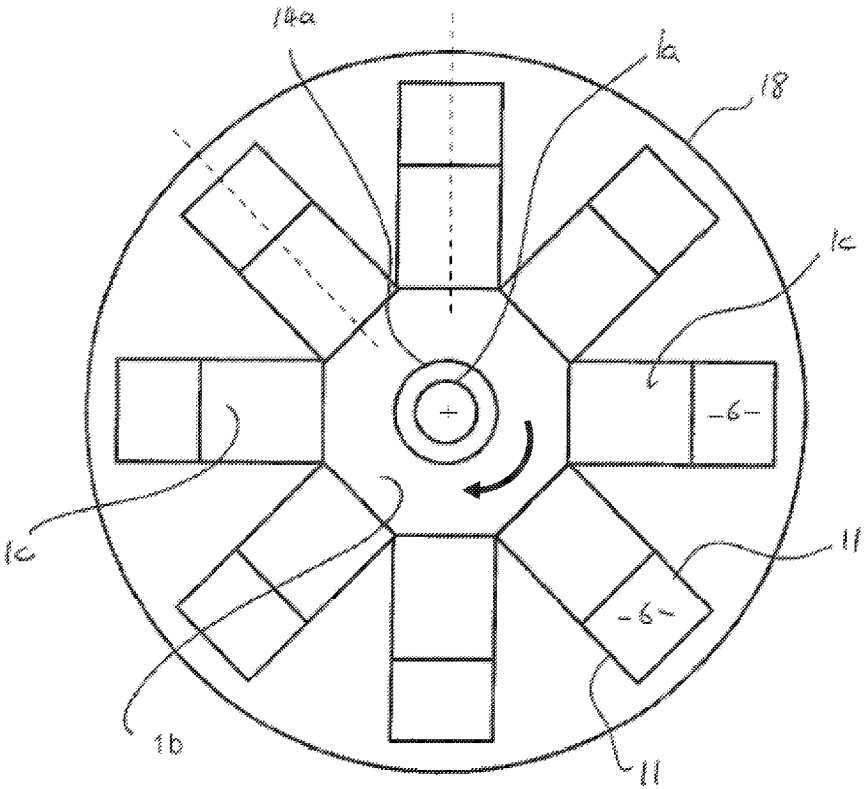
FIG. 2 is a diagrammatic cross-sectional plan view of the device shown in FIG. 1.

A rotating octagonal section structure 1*b* is attached to the central shaft 1 and in turn supports eight radial arms 1*c* extending outwardly from respective faces of the octagonal section structure 1*b* as can be clearly seen in FIG. 2.

Eight rectangular section vessels 2 are provided, one mounted beneath each of the eight radial arms 1*c*, so as to be rotatable by the central shaft 1 like the spokes of a wheel. Each vessel 2 has a rear sloping outer wall 3, a planar top wall 4, a lower wall 5, and two side walls 11. Each vessel has an outer region 6 and an inner region 7.

Extending between the outer region 6 and the inner region 7 in each vessel 2 is an array of closely spaced parallel inclined planes 8 positioned within the vessel such that the outer edges 9 of the plates are in communication with the outer region 6 and the inner edges 10 with the inner region 7.

The closely spaced parallel inclined plates 8 are spaced apart by channels which are typically less than 2 mm high. A typical example of plate spacing is 1.77 mm as referred to in our International Patent Application PCT/AU00/00058 where the inclined channels were 1.0 m long.

The term "closely spaced" is however relative to the overall size of the plate arrays and will also vary with the size of the particles to be treated. Generally, plate spacing could be as large as 6 mm and still result in some improved performance, but is ideally less than 2 mm and could be 0.05 mm or even less in some situations.

Although the arrays of closely spaced inclined plates have been described as mounted within rectangular boxes, it will be apparent that there are many other ways of mounting these arrays. In one form of the invention, the inclined channels between the plates 8 could be formed by layers of portions of cones in a continuous annulus extending between the inner region 7 and the outer region 6. It is however preferred to use the arrays of rectangular plates mounted within rectangular boxes as this is simpler and cheaper to manufacture and may give more controlled flows within the device.

The enhanced gravity separation device is further provided with fluidization means which may for example take the form of a fluid feed via eight conduits 14 from a supply annulus 14A, forming a fluidization zone 15. Fluidization fluid, such as water, is introduced into the fluidization zone 15 under pressure from where it is introduced into the outer region 6.

The outer region 6 is further provided with a plurality of outlet valves 16 which may be opened at various times to remove underflow material from the outer region 6. This material may be removed into a trough 17 formed beneath the outlet valves 16 and extending inwardly from a shroud 18 which surrounds the rotatable assembly.

In use, a feed of mixed denser and less dense particles in a liquid is introduced into a hollow central pipe 1*a* under pressure and then issues through eight conduits 21 and outlets 22 into the outer regions 6 where the mixed particles may be fluidized in the fluidization zones 15. This fluidized bed of particles then moves inwardly through the closely spaced channels between the inclined plates 8 against the enhanced gravitational field cause by the rotation of the assembly about the central shaft 1.

The less dense particles report to the overflow in the inner regions 7 from where they overflow into a launder 23 as shown by arrow 24, and through outlet 25 where they can discharge into the shroud 18 as shown by arrow 26 and hence to outlets 27.

The denser particles report to the outer regions 6 where they are periodically removed into the trough 17 by the opening of valves 16.

The present invention combines the benefits of a centrifugal force field with the powerful separation mechanism that arises in closely spaced inclined channels. A rotating system produces a high "g force" in the outwards radial direction. Boxes of parallel channels are located within the system. The inclined channels are tilted slightly with respect to the radial direction of the centrifugal force as shown in FIG. 1. By producing a high centrifugal force (eg) 100 g a 0.010 mm particle could settle as fast as a 0.100 mm particle settling under gravity. The centrifugal field, in combination with closely spaced inclined channels, promotes a powerful density based separation for particles larger than about 0.010 mm. Where a significant density difference exists between different particle species, the density based separation should apply to particles larger than about 0.002 mm. The centrifugal field, in combination with the closely spaced inclined channels also produces a considerable throughput advantage, permitting large hydraulic loadings.

Although the invention has been described in a particular application for the separation of mixed denser and less dense particles in a fluid feed, it would be appreciated that it may also be used as a method for solid-liquid separation where the aim is to produce a dilute liquid stream substantially free of solids and also a more concentrated stream containing a high fraction of the solids (particles). The dilute stream flows inwards in the radial direction while the solids predominantly move radially outwardly within the apparatus. In a further application, the device can be used to separate coarser and finer particles, predominantly of similar density. The finer particles then move towards the inner region while the coarser particles settle radially outwards within the apparatus. These are additional uses of the apparatus to the main application of separating particles on the basis of density.

It will be appreciated by those skilled in the art of centrifugal separators that there are many ways to deliver the feed, fluidize the system, and remove the underflow and the overflow. What is important here is the inclusion of a pathway that consists of parallel, inclined channels. The overflow suspension is forced through these channels for the purpose of promoting a stronger density based separation, and a higher hydraulic capacity.

The invention claimed is:

1. An enhanced gravity separation device comprising a plurality of vessels having outer and inner regions, radiating from and rotatable by a central shaft, a feeder for introducing a feed of mixed denser and less dense fluid matter into the outer regions of the vessels, an array of closely spaced inclined plates positioned within each vessel between the outer and inner regions such that overflow of less dense matter from the array reports to the inner region and underflow of denser matter reports to the outer region, the inclined plates being inclined relative to the central shaft, an underflow removal device for removing the underflow from the enhanced gravity separation device and an overflow removal device for removing the overflow from the enhanced gravity separation device, wherein the underflow and overflow removal devices are operable to remove the underflow and overflow, respectively, while the vessels are being rotated by the central shaft, and wherein said feeder comprises conduits each having a feeder outlet configured to introduce a fluidization fluid into of the outer regions of the vessels causing a fluidized bed to form in these outer regions directed towards said inclined plates, said feeder outlets each being located at a distal end of each outer region.

2. The device as claimed in claim 1 wherein the closely spaced inclined plates are separated by spacings which are less than 6 mm.

3. The device as claimed in claim 2 wherein the spacings are less than 2 mm.

4. The device as claimed in claim 1 wherein the fluid matter comprises a mix of denser and less dense particles in a liquid and wherein the less dense particles report to the inner region and the denser particles report to the outer region.

5. The device as claimed in claim 1 wherein the fluid matter comprises particles in a liquid and wherein a dilute stream of liquid substantially free of particles reports to the inner region, and a concentrated stream containing a high fraction of particles reports to the outer region.

6. The device as claimed in claim 1 wherein the fluid matter comprises particles of similar density in a liquid and wherein liquid containing finer particles reports to the inner region, and a concentrated stream containing a high fraction of coarser particles reports to the outer region.

7. The device as claimed in claim 1 wherein each array of closely spaced inclined plates is located within a substantially rectangular section of the vessel having an outer end open to the outer region and an inner end open to the inner region.

8. The device as claimed in claim 7 wherein each rectangular section of the vessel extends in a substantially radial direction from the central shaft like spokes of a wheel.

9. The device as claimed in claim 1 wherein the underflow removal device comprises one or more valves and the underflow is removed by periodically opening the one or more valves in the outer region.

10. The device as claimed in claim 1 wherein the overflow removal device comprises a launder and the overflow is removed via the launder receiving flow from the inner region.

11. The device as claimed in claim 1 wherein the closely spaced inclined plates are aligned parallel to a longitudinal axis of each vessel.

12. The device as claimed in claim 1 wherein the closely spaced plates are arranged to direct fluid flow parallel to a longitudinal axis of each vessel.

13. The device as claimed in claim 1 wherein the closely spaced inclined plates are aligned parallel to a wall of each vessel.

14. The device as claimed in claim 1 wherein the closely spaced plates are arranged to direct fluid flow parallel to a wall of each vessel.

15. The device as claimed in claim 1 wherein the closely spaced inclined plates each have an inner edge, the inner edges being located at substantially the same distance relative to one end of their respective vessel.

16. The device as claimed in claim 1 wherein the closely spaced inclined plates each have an outer edge, the outer edges being located at substantially the same distance relative to one end of their respective vessel.

* * * * *